US008351639B2

(12) United States Patent
Chang

(10) Patent No.: US 8,351,639 B2
(45) **Date of Patent: *Jan. 8, 2013**

(54) MULTI-DIRECTIONAL SOUND EMISSION SYSTEM

(75) Inventor: Kwangwu Chang, Hong Kong (CN)

(73) Assignee: IAG Group Ltd., Shenzhen (CN)

( * ) Notice: Subject to any disclaimer, the term of this patent is extended or adjusted under 35 U.S.C. 154(b) by 360 days.

This patent is subject to a terminal disclaimer.

(21) Appl. No.: 12/699,326

(22) Filed: Feb. 3, 2010

(65) Prior Publication Data

US 2011/0019844 A1 Jan. 27, 2011

(30) Foreign Application Priority Data

Jul. 23, 2009 (CN) ..... 2009 1 0109040

(51) Int. Cl.
*H04R 1/02* (2006.01)

(52) U.S. Cl. ..... 381/387; 381/338; 181/129

(58) Field of Classification Search ..... 381/338, 381/378, 387; 181/129

See application file for complete search history.

(56) References Cited

U.S. PATENT DOCUMENTS

| | | | | |
|---|---|---|---|---|
| 526,046 | A * | 9/1894 | Mckervey | 181/129 |
| 7,010,138 | B1 * | 3/2006 | Harris et al. | 381/337 |
| 7,356,155 | B2 * | 4/2008 | Monnie et al. | 381/338 |

* cited by examiner

*Primary Examiner* — Curtis Kuntz
*Assistant Examiner* — Amir Etesam
(74) *Attorney, Agent, or Firm* — Hamre, Schumann, Mueller & Larson, P.C.

(57) ABSTRACT

A multi-directional sound emission system comprises a speaker body and sound emission devices coupled to both ends of the speaker body. The sound emission devices each include a sound emission means for directionally emitting sound towards multiple directions. The sound emission means includes a plurality of hollow mechanical sound conducting elements. Each hollow mechanical sound conducting element has an inner opening end and an exterior opening end opposite to the inner opening end. The exterior opening ends of the sound conducting elements are directed towards desired multiple directions, respectively. The sound emission means is configured for receiving sound signals from the speaker body and emitting sound along the desired multiple directions through the sound conducting elements.

19 Claims, 15 Drawing Sheets

MULTI-DIRECTIONAL SOUND EMISSION SYSTEM

TECHNICAL FIELD

The present invention relates to speaker devices and, more particularly, to a multi-directional sound emission system, which can generate a plurality of sound channels.

BACKGROUND

With the increasing of people's life level, a demand for high-quality speaker systems has increased dramatically over the last twenty years. At present, a traditional speaker system generally can produce a stereophonic effect with a plurality of channels by setting a set of stereophonic speaker assembly.

For example, a typical stereophonic speaker assembly includes a pair of primary loudspeakers and a pair of secondary separate loudspeakers to form four sound emission fields. However, such a speaker assembly is tack of a sense of three-dimensional depth. Stereophonic effect can only be enjoyed at a middle location between the two loudspeakers. If the listener is adjacent to one loudspeaker but is far from the other loudspeaker, the stereophonic effect is significantly decreased. Further, in this structure, the speaker assembly occupies a large space in a room and it is inconvenient to carry and move away.

Some stereophonic speaker assemblies can achieve surround sound effect by a surround sound system. The surround sound system simulates a desired three-dimensional environment by directing sound to the listener from various orientations, including front, side, back, floor and ceiling propagation. Modem surround sound systems capitalize on diverse speakers to generate both stereophonic and multi-channel output, as well as synchronized shifting of isolated sounds to individual speakers disposed around the listener. For example, a speaker assembly is equipped with a speaker array constituting a 5.1ch surround sound system, e.g., a front left channel, a front right channel, a center channel, a rear left channel, a rear right channel, and a subwoofer LFE(Low Frequency Effects)ch.

However, such speaker assembly with a speaker array requires a complex structure and technology, and at the same time this brings about many undue problems. For example, the wiring for coupling the loudspeakers to a sound source makes the room untidy. In effect, this complex speaker assembly has disadvantageous influence on interior decoration. Furthermore, requirement for multi-direction separate loudspeakers results in an expensive cost of such speaker assembly.

At present, some speaker assemblies use a digital process technology to obtain desired surround sound effect. This digital speaker assembly typically includes a speaker array apparatus. The speaker array apparatus includes a plurality of speaker units from which audio is outputted and reflected with directivity against a predetermined wall surface or a reflection plate so as to form a virtual speaker. Each of the plurality of speaker units is independently driven so that an audio beam generated according to the input audio signal by a digital signal processor is emitted to a predetermined focal point position in a space. Although this digital speaker assembly enables realization of a wide listening range and a sound image positioning, it requires a very complex digital circuit system and various electronic elements. This increases complexity of design, as well as cost of the product. The high expensive product suppresses wide application of the digital speaker assemblies.

There is, therefore, a need for a multi-directional sound emission system, which has a compact structure and a reduced cost, and is portable and easy to assemble.

SUMMARY

In accordance with an embodiment of the present invention, a multi-directional sound emission system comprises a speaker body and sound emission devices coupled to both ends of the speaker body. The sound emission devices each include a sound emission means for directionally emitting sound towards multiple directions. The sound emission means includes a plurality of hollow mechanical sound conducting elements. Each hollow mechanical sound conducting element has an inner opening end and an exterior opening end opposite to the inner opening end. The exterior opening ends of the sound conducting elements are directed towards desired multiple directions, respectively. The sound emission means is configured for receiving sound signals from the speaker body and emitting sound along the desired multiple directions through the sound conducting elements.

In the above-described multi-directional sound emission system, sound from the speaker body (i.e., sound source) can be directed the desired multiple directions according to actual demands through the sound conducting elements. Thus, the listener situated at any position of a room can receive sound from multiple directions to obtain a stereophonic effect. The present multi-directional sound emission system has a combined sound body and sound emission means and thus is free of the multiple separate speakers which are required in traditional sound system. The plurality of hollow mechanical sound conducting elements integrated with the sound body can achieve a desired multi-channel output, without many complex speakers, expensive digital process devices or complicated digital circuit. The present multi-directional sound emission system has a compact structure and a reduced cost, and is portable and easy to assemble. The plurality of hollow mechanical sound conducting elements use acoustic principle to carry out a directive sound propagation, accordingly, multi-channel outputs can synchronously be achieved based on a single front sound body (sound source). Since the present system does not require additional separate speakers around the listener, thus greatly reducing space of the system. Further, it is also convenient for the system to readily carry away.

Other objects, advantages and novel features of the present invention will become more apparent from the following detailed description when taken in conjunction with the accompanying drawings, in which:

DETAILED DESCRIPTION OF THE PREFERRED EMBODIMENTS

Objects, advantages and embodiments of the present invention will be explained below in detail with reference to the accompanying drawings. However, it is to be appreciated that the following description of the embodiment(s) is merely exemplary in nature and is no way intended to limit the invention, its application, or uses.

Figure 1:
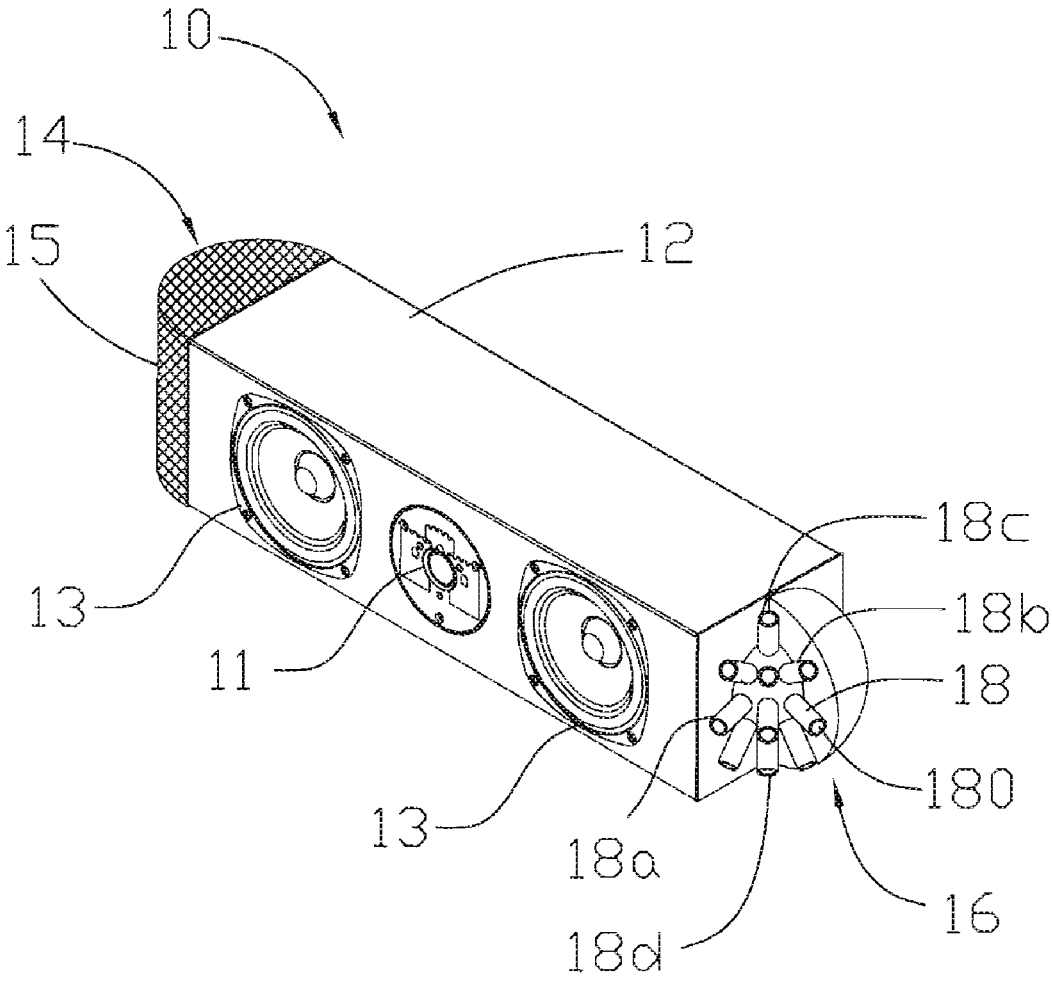
FIG. 1 is a schematic, isometric view of a multi-directional sound emission system according to a first embodiment of the present invention.
Figure 2:
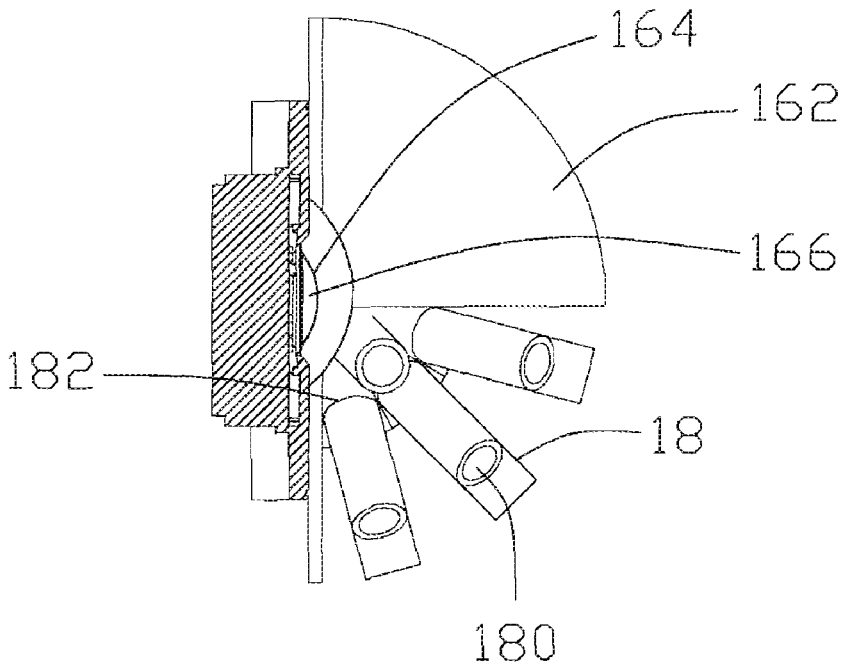
FIG. 2 is a schematic, side view of a sound emission means of the multi-directional sound emission system of FIG. 1.
Figure 3:
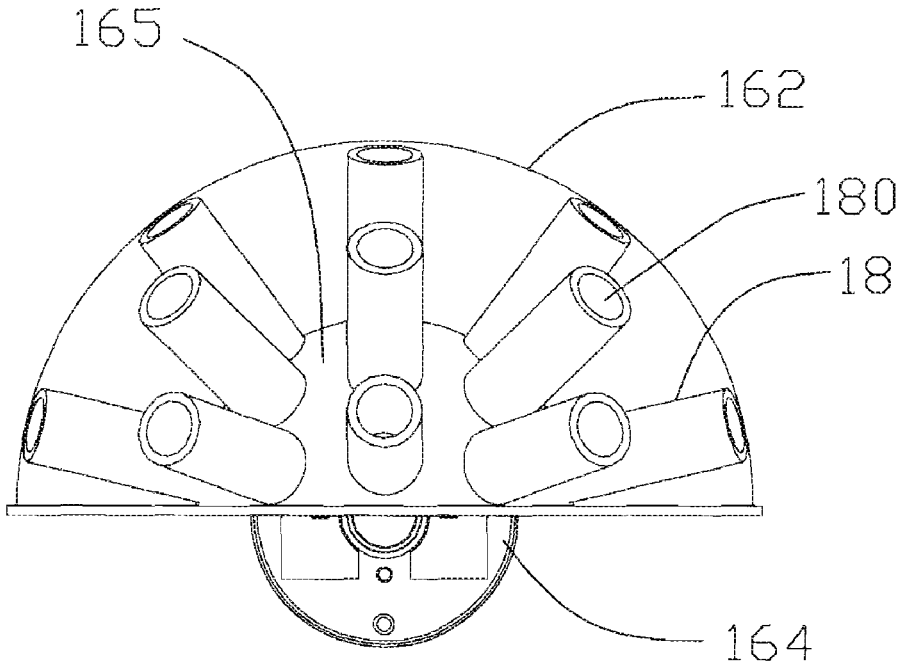
FIG. 3 is a schematic, front view of the sound emission means of the multi-directional sound emission system of FIG. 1.

Referring to FIGS. 1, 2 and 3, a multi-directional sound emission system 10 is shown in accordance with a first embodiment of the present invention. The multi-directional sound emission system 10 comprises a speaker body 12 and sound emission devices 14 coupled to both ends of the speaker body 12. The sound emission devices 14 each include a sound emission means 16 for directionally emitting sound towards multiple directions. The sound emission means 16 includes a plurality of hollow mechanical sound conducting elements 18. Each hollow mechanical sound conducting element 18 has an inner opening end 182 and an exterior opening end 180 opposite to the inner opening end. The exterior opening ends 180 of the sound conducting elements 18 are directed towards desired multiple directions, respectively. The sound emission means 16 is configured for receiving sound signals from the speaker body 12 and emitting sound along the desired multiple directions through the sound conducting elements 18.

In the illustrated embodiment, the speaker body 12 and the sound emission devices 14 is integrated or configured as a whole. As shown in FIG. 1, the multi-directional sound emission system 10 is substantially a three-channel sound system. The speaker body 12 is provided with a sound source device (not shown) for receiving sound input from external apparatus, e.g., a TV set or a DVD player. The speaker body 12 includes an audio middle frequency controller 11 and two speakers 13 coupled to both ends of the controller 11. The middle frequency controller 11 and the two speakers 13 cooperatively constitute a center channel. The sound emission devices 14 at both ends of the speaker body 12 (e.g., at the left and right sides of the speaker body 12) respectively serve as a left surround channel and a right surround channel (the positions herein is referred to as the positions shown in the figures).

As shown in the FIG. 1, the sound emission devices 14 at both ends of the speaker body 12 each have a sound emission means 16 for directionally emitting sound towards multiple directions. As seen in FIG. 1, the sound emission devices 14 coupled to right side of the speaker body 12 includes a plurality of hollow mechanical sound conducting elements 18 radially distributed in a three-dimensional direction, thereby emitting sound along various directions in three-dimension. Each sound emission device 14 further includes a porous cover 15 configured for protecting the sound conducting elements 18 therein from being injured and allowing sound to pass through. In an embodiment, the porous cover 15 is a metal or plastic mesh enclosure. In FIG. 1, the right porous cover 15 protecting the sound conducting elements 18 is removed away to show inner structure of the right sound emission device 14, while the left porous cover 15 is kept to cover the left sound conducting elements 18 therein.

FIGS. 2 and 3 are a side view and a front view of the sound emission means 16, respectively. The sound emission means 16 includes a base 162 with a loudspeaker 164 and the plurality of mechanical sound conducting elements 18 thereon. The loudspeaker 164 has an opening 166 where the sound is emitted. The opening 166 is in sound communication with the plurality of mechanical sound conducting elements 18, e.g., with the inner opening ends 182 of the elements 18. In an embodiment, the sound conducting elements 18 are sound conducting conduits 18. For example, the sound conducting conduits 18 could be a hollow pipe with the inner opening end 182 and the exterior opening end 180 opposite to the inner opening end 182, as shown in FIGS. 2 and 3. A sphere mask 165 is overlaid at the opening 166. The inner opening end 182 of each sound conducting conduit 18 is penetrated through the sphere mask 165 to be in sound communication with the loudspeaker 164 and the exterior opening end 180 is directed to outside. Herein, "sound communication" means that the sound from the opening 166 is propagated outwardly along the sound conducting elements 18. For example, in one embodiment of the present invention, the opening 166 is in direct (e.g., gas) communication with the sound conducting conduits 18. In an alternative embodiment of the present invention, the opening 166 is shielded with a vibrating membrane or a mesh mask. In this case, although the opening 166 is not in direct communication with the sound conducting conduits 18, the sound can be transferred to the sound conducting conduits 18, e.g., by means of vibration, and then spread out through the sound conducting conduits 18. Advantageously, the sound conducting conduits 18 are protruded out of the base 162 according to predetermined exit angle or position distribution, such as for example in a radially divergent form as shown in FIG. 3. In the illustrated embodiment, the plurality of sound conducting conduits 18 is in a spherical divergent form. For example, the sound conducting conduits 18 extend along imaginary normal directions which are converged to a spherical center of the sphere mask 165. The spherical center of the sphere mask 165 is preferably a center of the opening 166. The sphere mask 165 could be a partial sphere or a quarter sphere (as shown in FIG. 3). In this case, the exterior opening ends 180 of the sound conducting conduits 18 are appeared as a spherical profile or a curved profile.

Figure 4:
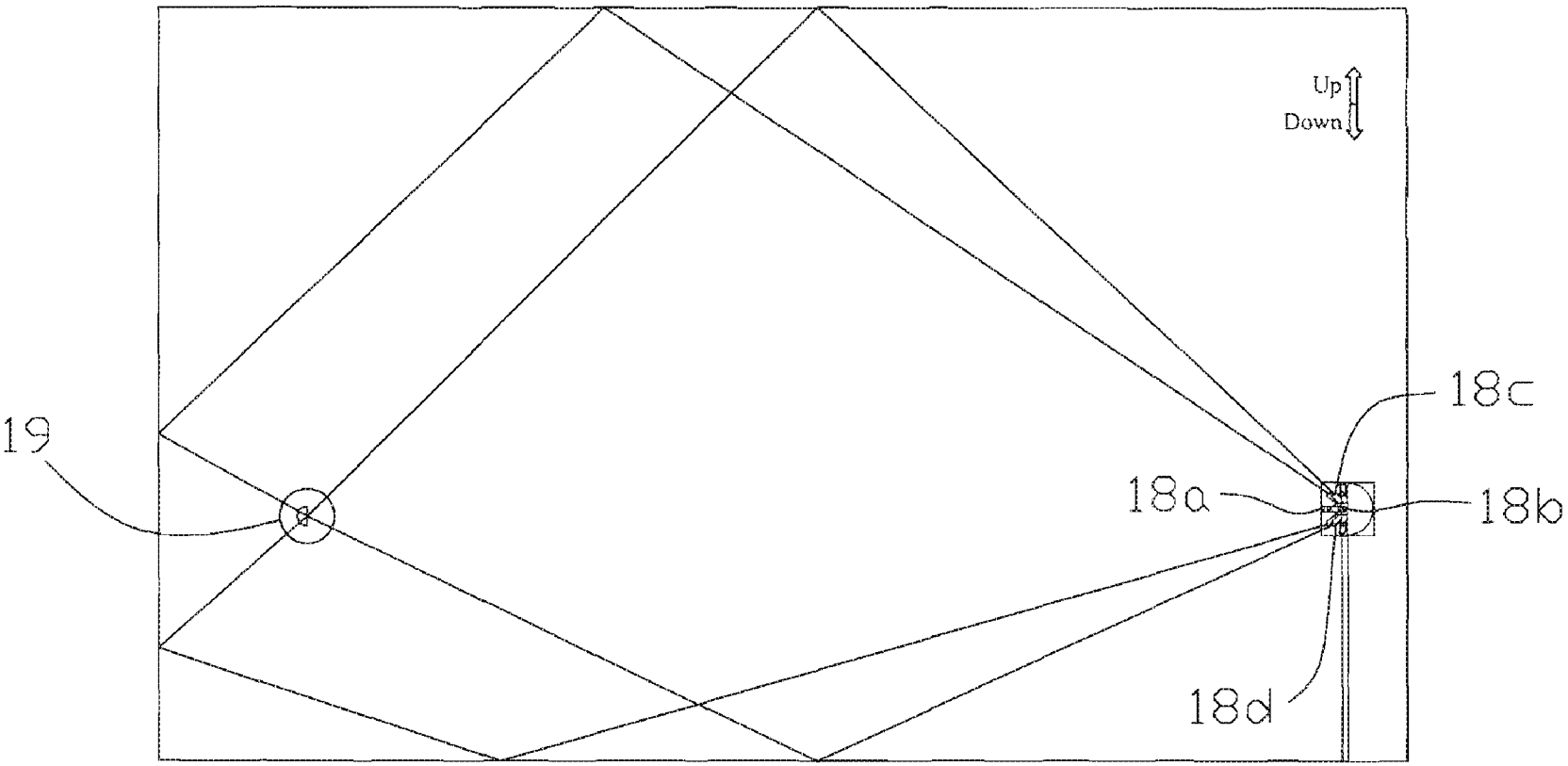
FIG. 4 is a schematic, top view of a room where the multi-directional sound emission system of FIG. 1 is applied, showing sound broadcasting paths along two up and down directions.

As shown in FIGS. 1 and 4, in the sound emission means 16 on the right, the sound conducting conduits 18 includes a group of front sound conducting conduits 18*a*, a group of lateral sound conducting conduits 18*b*, a group of upper sound conducting conduits 18*c*, and a group of lower sound conducting conduits 18*d*. Each of the four groups of sound conducting conduits 18*a* includes at least one sound conducting conduit. As shown in FIGS. 1 and 4, the front sound conducting conduits 18*a* are directed to direct or biased front of the speaker body 12, for propagating sound along a forward direction. For example, the openings of the front sound conducting conduits 18*a* face towards the direct or biased front of the speaker body 12. The front sound conducting conduits 18*a* on the right produce anterolateral sound wave and serve as a front right channel.

Figure 5:
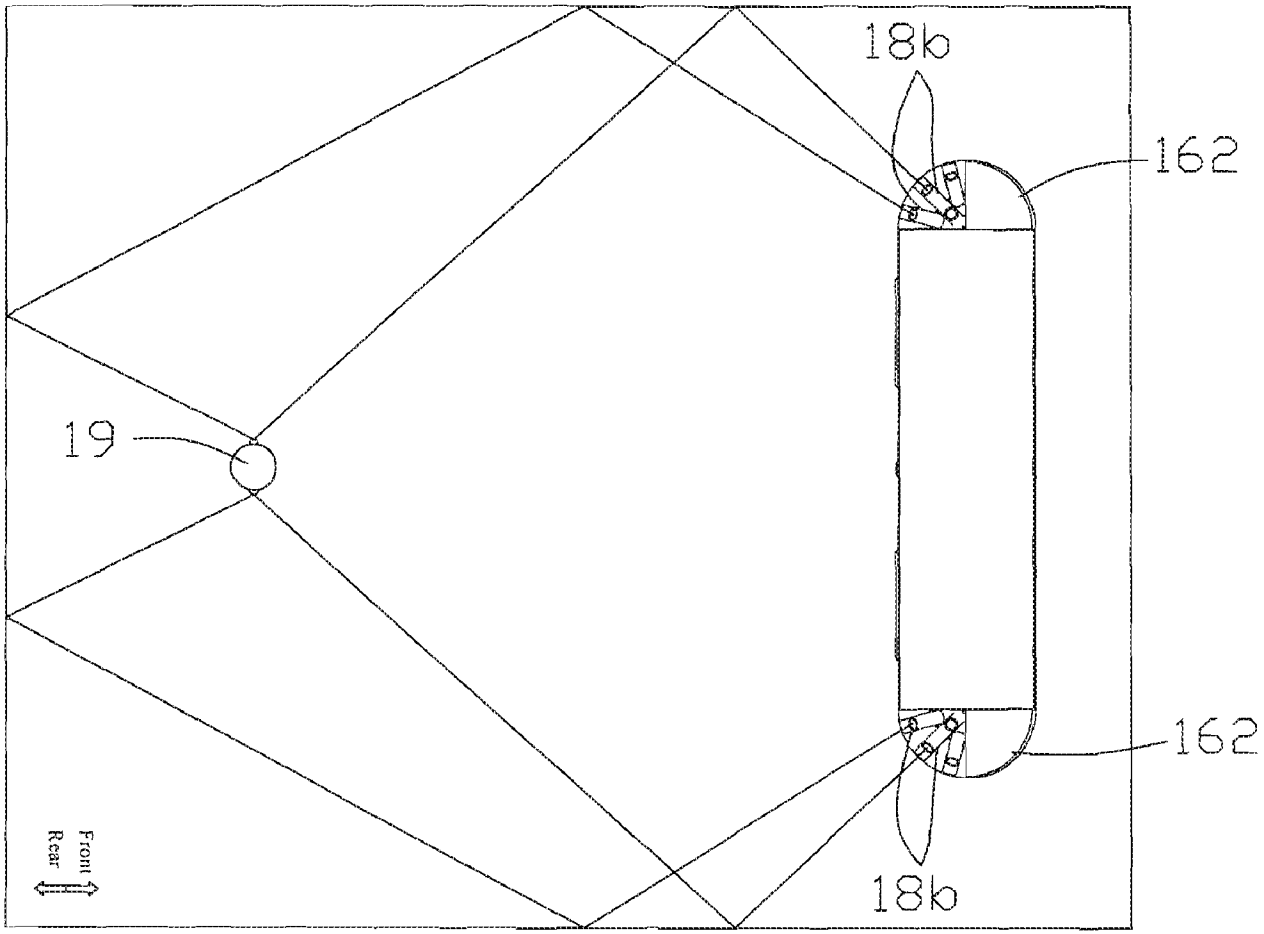
FIG. 5 is a schematic, side view of the room where the multi-directional sound emission system of FIG. 1 is applied, showing sound broadcasting paths along lateral directions.

The lateral sound conducting conduits 18*b* on the right are directed to direct or biased lateral of the speaker body 12, for propagating sound along a lateral direction. For example, the openings of the lateral sound conducting conduits 18*b* face towards the direct or biased lateral of the speaker body 12. Referring to FIG. 5, if the sound emission system 10 is placed in a room, most of the sound waves from the lateral sound conducting conduits 18*b* are reflected towards a listening location 19 by side walls. Some sound waves from the lateral sound conducting conduits 18*b* are reflected twice, e.g., firstly towards a rear wail by the side walls and then towards the listening location 19 by the rear wall.

As shown in FIGS. 1 and 4, the upper sound conducting conduits 18*c* are directed to direct or biased above of the speaker body 12, for propagating sound along an upward direction. For example, the openings of the upper sound conducting conduits 18*c* face towards the direct or biased above of the speaker body 12. Referring to FIG. 4 again, if the sound emission system 10 is placed in a room, most of the sound waves from the upper sound conducting conduits 18*c* are reflected towards a listening location 19 by a ceiling. Some sound waves from the upper sound conducting conduits 18*c* are reflected twice, e.g., firstly towards the rear wall by the ceiling and then towards the listening location 19 by the rear wall.

Likewise, as shown in FIGS. 1 and 4, the lower sound conducting conduits 18*d* are directed to direct or biased below of the speaker body 12, for propagating sound along a downward direction. For example, the openings of the lower sound conducting conduits 18*d* face towards the direct or biased below of the speaker body 12. Referring back to FIG. 4, if the sound emission system 10 is placed in a room, most of the sound waves from the lower sound conducting conduits 18*d* are reflected towards a listening location 19 by a floor. Some sound waves from the lower sound conducting conduits 18*d* are reflected twice, e.g., firstly towards the floor by the floor and then towards the listening location 19 by the rear wall.

Accordingly, the sound emission means 16 on the right serves as a right surround channel in relation to the listening location 19 by means of the four groups of sound conducting conduits 18*a*, 18*b*, 18*c*, 18*d*. Likewise, the left sound emission means 16 has the same structure to the right sound emission means 16 and thus serves as a left surround channel in relation to the listening location 19 by means of similar four groups of sound conducting conduits on the left.

The length of the sound conducting conduits 18 may be uniform or different from each other. The sizes of the openings of the sound conducting conduits 18 may be uniform or different from each other. In some embodiments, the sound conducting conduits 18 are in a tubular shape. The tubular sound conducting conduits 18 have narrow openings (e.g., narrow opening end 180) and are elongated, and thus emit acute sound. In other embodiments, the tubular sound conducting conduits 18 have large opening (e.g., large opening end 180) and are shorten, and thus emit mild and dull sound. It is to be understood that the sizes and shapes of the sound conducting conduits 18 could be designed according to actual demands. In addition, the length and opening diameters of the sound conducting conduits 18 and materials of the conduits could be selected to achieve desired quality, sound frequency, phase and interference of sound emitted therefrom. Therefore, the length and opening diameters of the sound conducting conduits 18 (the same to other following mechanical sound conducting elements) could be designed based on acoustic principle in physics. Further, the arrangement (e.g., divergent angles and intervals between the conduits) of the sound conducting conduits 18 on the base 162 could be designed based on acoustic principle in physics in accordance with actual demand.

Figure 6:
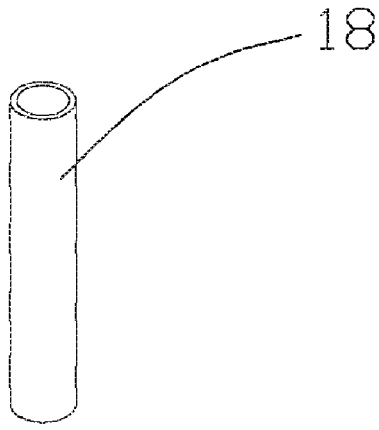
FIG. 6 is a schematic view of a first sound conduit of the multi-directional sound emission system of FIG. 2.
Figure 7:
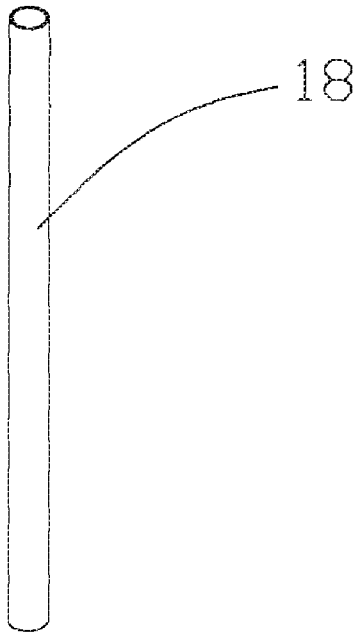
FIG. 7 is a schematic view of a second sound conduit of the multi-directional sound emission system of FIG. 2.
Figure 8:
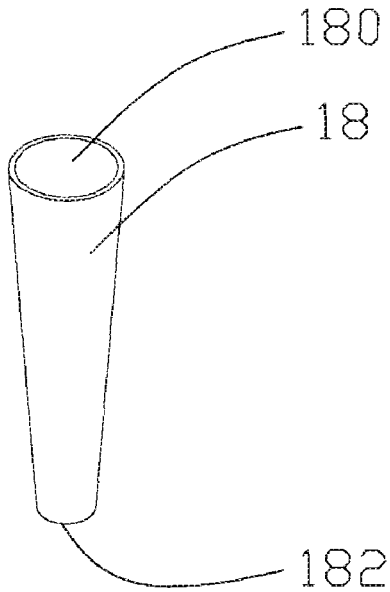
FIG. 8 is a schematic view of a third sound conduit of the multi-directional sound emission system of FIG. 2.
Figure 9:
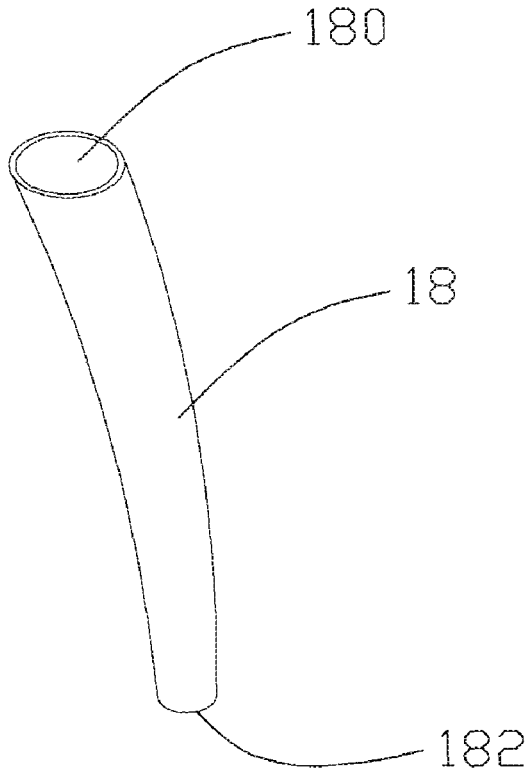
FIG. 9 is a schematic view of a fourth sound conduit of the multi-directional sound emission system of FIG. 2.
Figure 10:
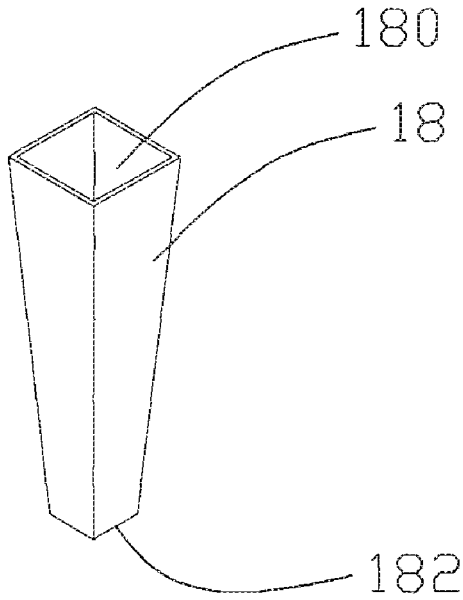
FIG. 10 is a schematic view of a fifth sound conduit of the multi-directional sound emission system of FIG. 2.

Referring to FIGS. 6 through 11, a variety of sound conducting conduits 18 with various shapes are shown. As shown in FIG. 6, the sound conducting conduit 18 has the same shapes to that in FIG. 1, namely the conduit 18 is a straight circular tube with uniform diameter. In FIG. 7, the sound conducting conduit 18 is similar to the conduit in FIG. 6, except that the conduit 18 in FIG. 7 has a relatively larger length and smaller diameter than the conduit 18 in FIG. 6. As shown in FIG. 8, the sound conducting conduit 18 is a straight circular tube with a tapered structure from the outer opening end 180 to the inner opening end 182, like a trumpet. That is, the inner opening end 182 has a smaller diameter than the outer opening end 180. The sound conducting conduit 18 in FIG. 9 is a curved circular tube with a tapered structure from the outer opening end 180 to the inner opening end 182, like a horn. The sound conducting conduit 18 in FIG. 10 is a straight cubic tube with a tapered structure from the outer opening end 180 to the inner opening end 182.

Figure 11:
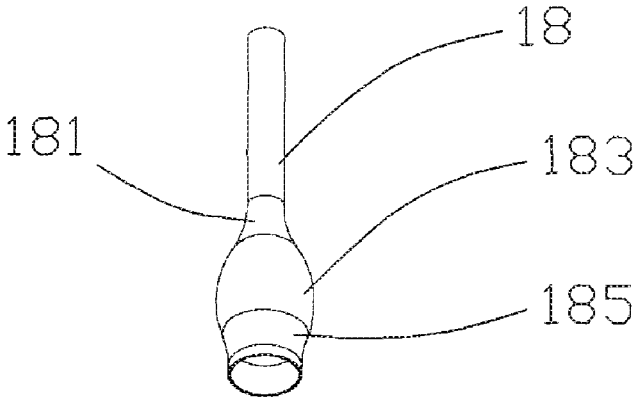
FIG. 11 is a schematic view of a sixth sound conduit of the multi-directional sound emission system of FIG. 2.

Referring to FIG. 11, in an embodiment, the sound conducting conduit 18 is substantially a straight tube and includes a drum-shaped portion and a narrow straight tubular portion. The narrow opening end has a relatively smaller diameter than the drum-shaped portion, and thus the sound conducting conduit 18 is provided with a large opening end and a narrow opening end opposite to the large opening end. The drum-shaped portion is substantially gyrorotor and includes three segments, e.g., an exterior end segment 181 with the large opening end, a drum segment 183 and a transition segment 185 coupling the drum segment 183 to narrow straight tubular portion. Thus, the sound conducting conduit 18 is seemed to be a conch or functioned as a conch.

In some embodiments, the sound emission means 16 could include any combination of these sound conducting conduits 18 with various shapes above-mentioned. The sound conducting conduits 18 are made of many kinds of available materials which aid in conduction and propagation of sound and have no influence on sound quality. The available materials could be a material used in typical musical instruments, for example, copper or wood.

It is to be understood that the cross section of the sound conducting conduit 18 could be in a polygon shape, for example, triangle, pentagon or more. It is to be appreciated that various variations about the sound conducting conduit are construed in the scope of the present invention.

The sound emission device 14 is coupled to the speaker body 12 by means of mechanical engagement, for example, a snapping means, a welding means or a screw means. In an embodiment, the base 162 of the sound emission means 16 is provided with a fastening member by that the base 162 is attached to the speaker body 12. The loudspeaker 164 is coupled to the speaker body 12 or the base 162 by means of mechanical engagement, for example, a snapping means, a welding means or a screw means. Advantageously, the sound conducting conduits 18 are coupled to the sphere mask 165 on the loudspeaker 164 by means of mechanical engagement, for example, a snapping means, a welding means or a screw means. Accordingly, each parts of the sound emission device 14 can be assembled together with the speaker body 12 by means of mechanical engagement, and thus do not require complex speaker structure and connection means, complicated digital process device and digital process circuit. Thus, the sound emission system 10 is easy to assemble and occupies small space.

Figure 12:
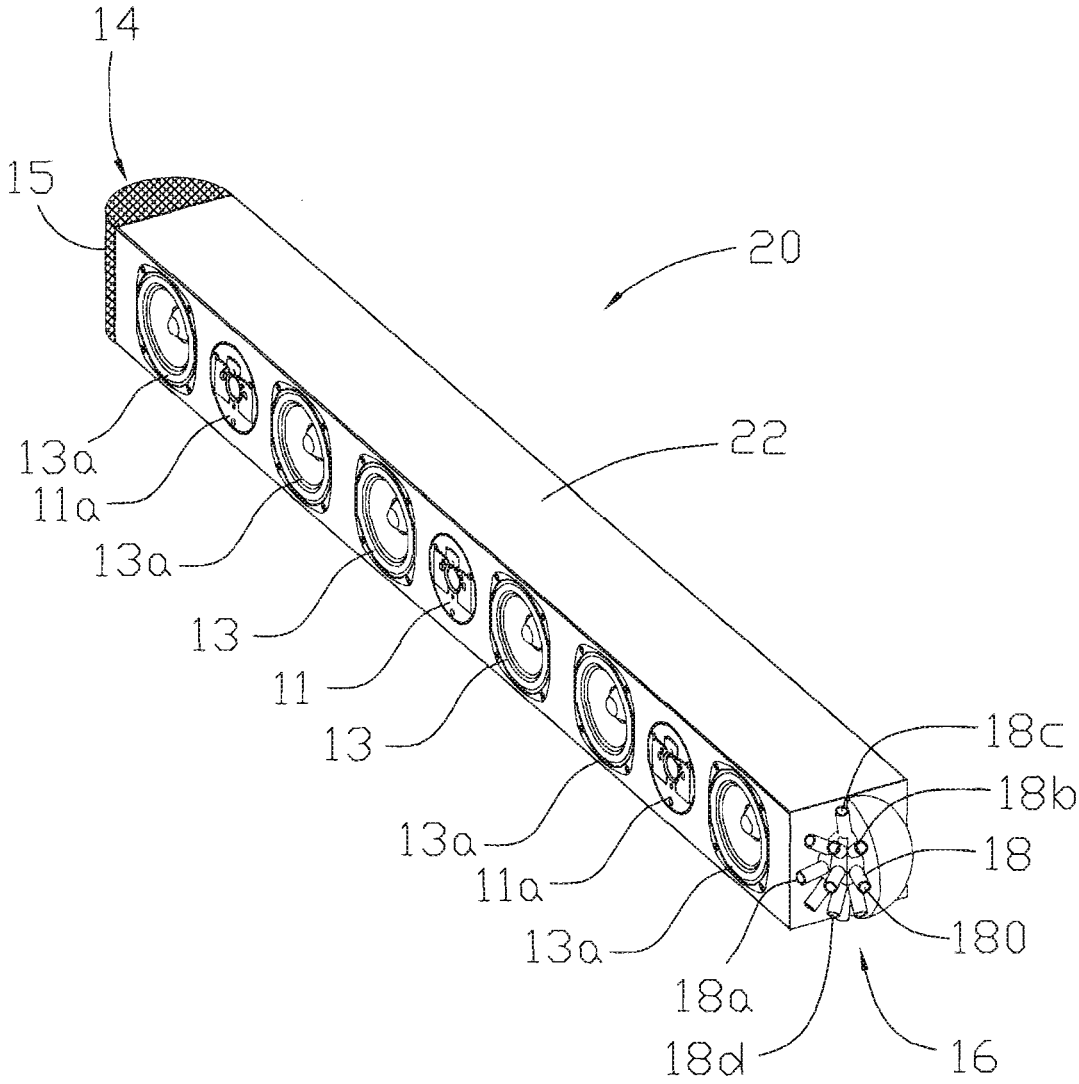
FIG. 12 is a schematic, isometric view of a multi-directional sound emission system according to a second embodiment of the present invention.

Referring to FIG. 12, a multi-directional sound emission system 20 is shown in accordance with a second embodiment of the present invention. The multi-directional sound emission system 20 is similar to the above-described multi-directional sound emission system 10, except that the sound emission system 20 is a five-channel sound system. The reference numbers used in FIG. 12 are similar to those in FIG. 1 and the parts designated by the same reference numbers to FIG. 1 are similar to those parts described above.

The sound emission system 20 includes a speaker body 22 and the above two sound emission devices 14 coupled to both ends of the speaker body 22. The two sound emission devices 14 is respectively serve as a left surround channel and a right surround channel, as described above. The structure of the sound emission devices 14 is shown in FIGS. 1 through 11. The speaker body 22 is provided with three channels, e.g., a front left channel, a front right channel and a center channel. The center channel includes the middle frequency controller 11 and the two speakers 13, similarly to those described above in the first embodiment. The front left channel and the front right channel are coupled to both ends of the center channel and have similar construction to the center channel. For example, the left and right channels each include an audio middle frequency controller 11*a* and two speakers 13*a* respectively disposed at both ends of the middle frequency controller 11*a*. The middle frequency controller 11*a* and the two speakers 13*a* are respectively similar to the middle frequency controller 11 and the two speakers 13. In this way, the center channel, the front left channel, the front right channel, the left surround channel and the right surround channel constitute cooperatively constitute a five-channel structure of the sound emission system 20.

Figure 13:
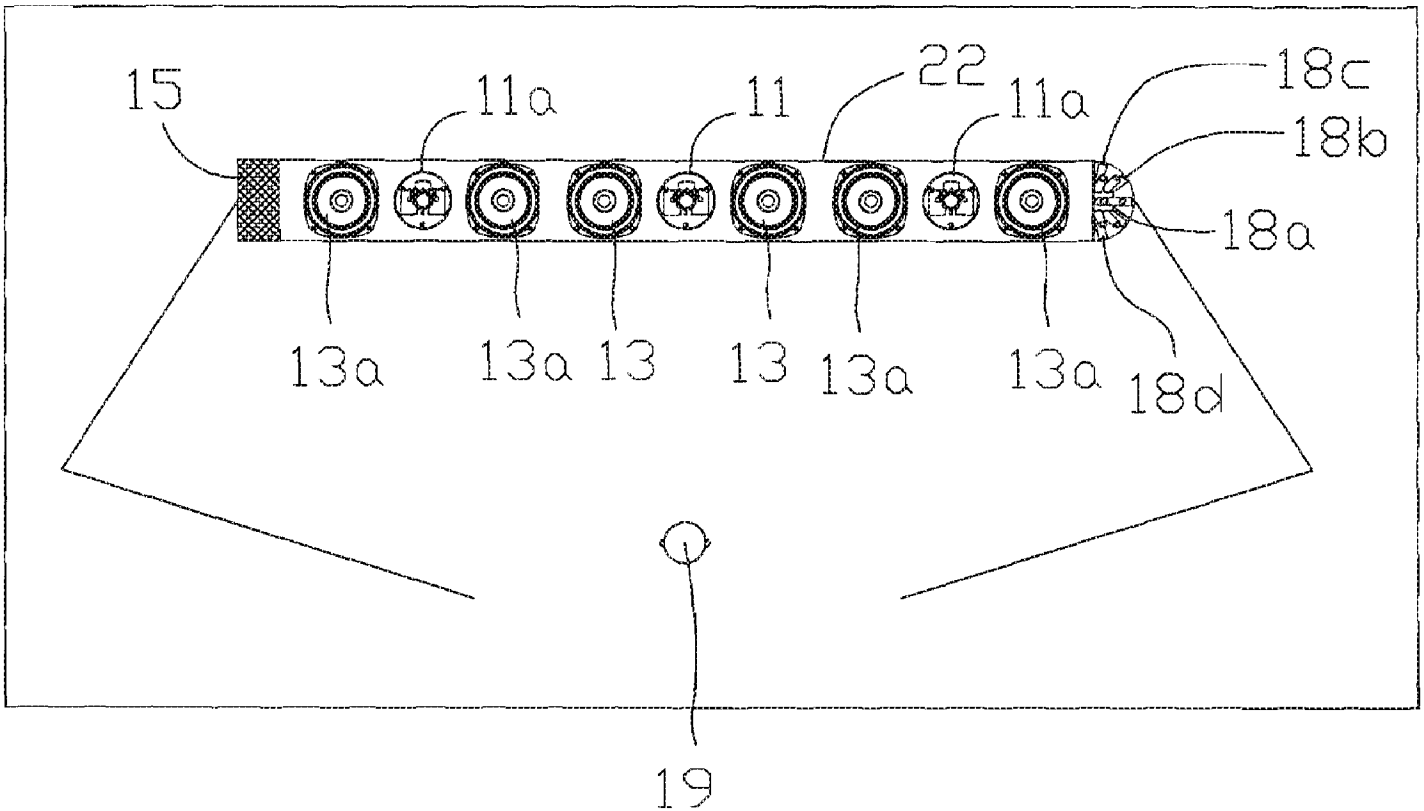
FIG. 13 is a schematic, top view of a room where the multi-directional sound emission system of FIG. 1 is applied, showing a left surround effect and a right sound surround effect.
Figure 14:
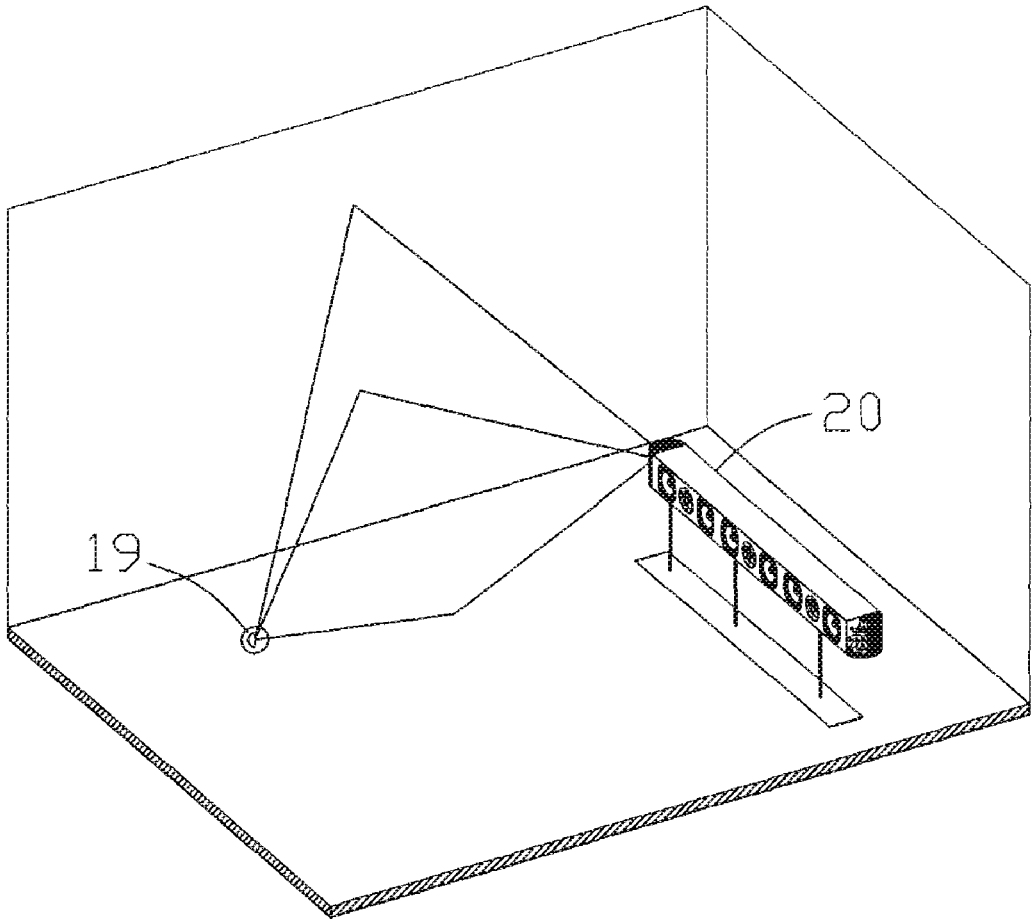
FIG. 14 is a schematic, isometric view of the room where the multi-directional sound emission system of FIG. 12 is applied, showing sound broadcasting paths emitted from one sound emission means.

The sound emission system 20 is essentially a 5.1ch surround sound system with the five channels integrated together with the speaker body 22 as a whole. In practice, the sound emission system 20 can be positioned adjacent to some music sources or display devices, for example, Television Set, Music Television (MTV), cinema screen to transfer the music or sound to the viewers or listeners by the five channels thereof, thereby achieving a 5.1ch surround effect. That is, in case that the sound emission system 20 is disposed at the front of the listener, the 5.1ch surround effect is achieved without additional separate speakers. As shown in FIGS. 13 and 14, part of sound transferred from the sound conducting conduits 18 is reflected towards the listener once by the sidewalls to form an imaginary side sound source, such that the listener (e.g., locating at the listening location 19) feels that this part of sound is emitted from both sides. Part of sound transferred from the sound conducting conduits 18 is reflected towards the listener once by the ceiling to form an imaginary top sound source, such that the listener feels that this part of sound is emitted from the ceiling. Part of sound transferred from the sound conducting conduits 18 is reflected towards the listener twice by the sidewalls or the ceiling and then by the rear wall to form an imaginary hack sound source, such that the listener feels that this part of sound is emitted from back thereof. Thus, the present sound emission system 20 is devoid of a number of separate speakers surrounding the listening location 19, as required in the traditional sound devices.

In the sound emission system 20, sound is transferred with directivity based on mechanical structure, e.g., the sound conducting conduits 18 such that the entire configuration of the system 20 is compact and easy to assemble, and thus is devoid of complex separate speakers, expensive digital process devices or complicated digital circuit. It is to be understood that some further sound emission means 16 could be arranged at desired portion of the speaker body 12, e.g., top of the speaker body 12 to achieve more than five sound channels, for example seven channels or more.

Figure 15:
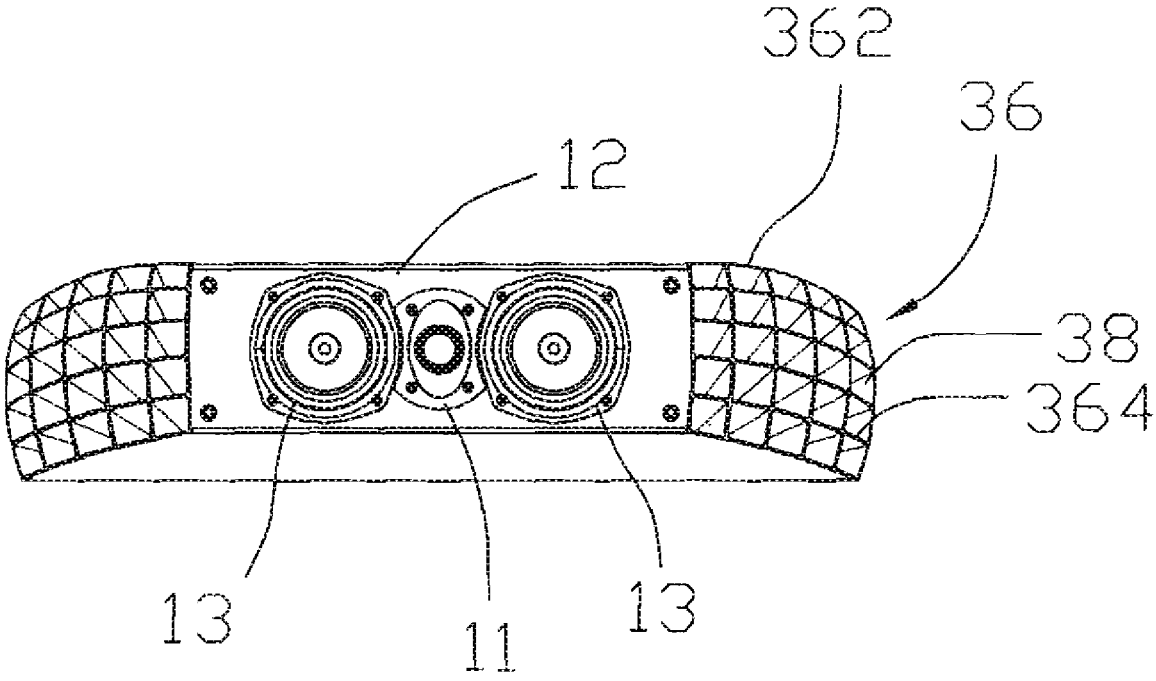
FIG. 15 is a schematic, isometric view of a multi-directional sound emission system according to a third embodiment of the present invention.
Figure 16:
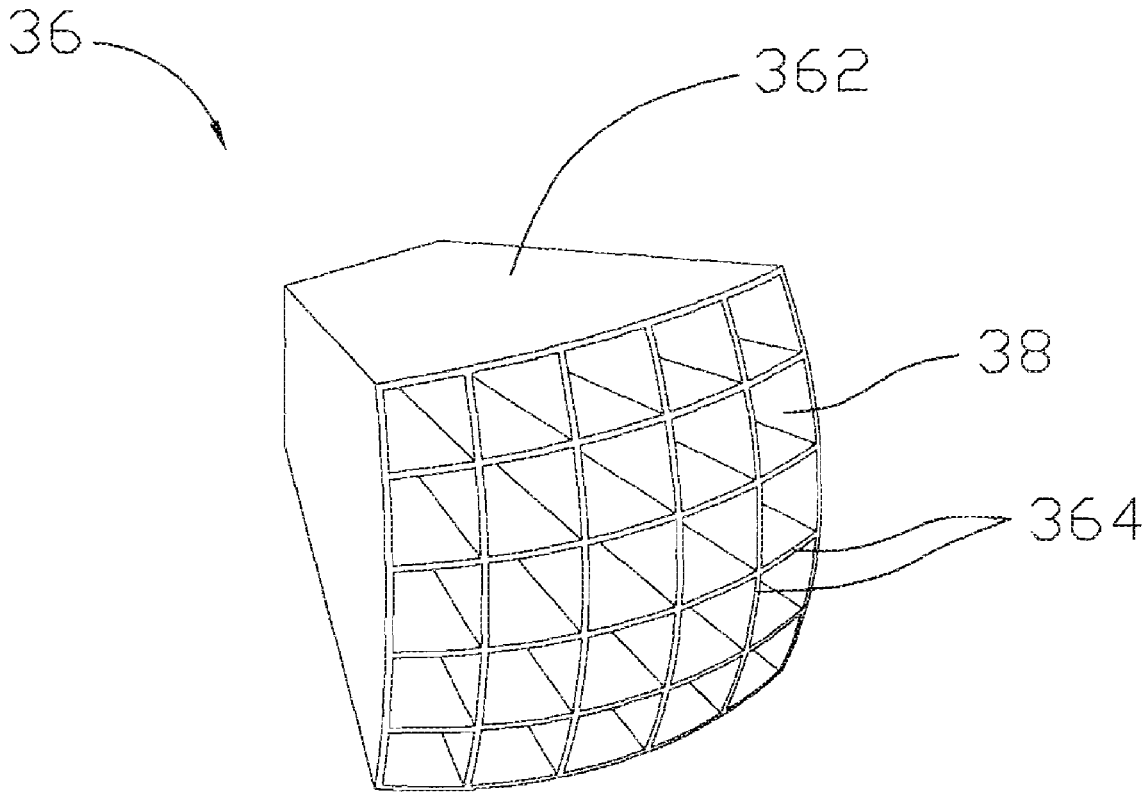
FIG. 16 is a schematic, isometric view of a mechanical sound conducting means of the multi-directional sound emission system of FIG. 15.

Referring to FIGS. 15 and 16, a multi-directional sound emission system 30 is shown in accordance with a third embodiment of the present invention. The multi-directional sound emission system 30 is similar to the above-described multi-directional sound emission system 10, except that the sound emission means 36. The reference numbers used in FIGS. 15 and 16 are similar to those in FIG. 1 and the parts designated by the same reference numbers to FIG. 1 are similar to those parts described above. The sound emission means 36 has a plurality of mechanical sound conducting elements 38.

As shown in FIG. 16, the sound emission means 36 includes an enclosure 362 and a plurality of separators 364. The enclosure 362 is functioned as a base like the base 162. In the illustrated embodiment, the enclosure 362 includes a top portion and a bottom portion respectively extending along a top surface and a bottom surface of the speaker body 12 and thus is in a hopper shape. The separators 364 are arranged in the enclosure 362 in an array form and are intersecting to each other, e.g., forming a crisscross arrangement. For example, the array of separators 364 includes a vertical array of separators 364 and a horizontal array of separators 364. The vertical and horizontal arrays of separators 364 cooperatively define the plurality of mechanical sound conducting elements 38 therebetween. Accordingly, the mechanical sound conducting elements 38 are aligned in an array form. Each of the sound conducting elements 38 has a through-hole and may be a rectangular tube. As shown in FIG. 16, the separators 364 may be a fan-shaped panel and thus form the sound conducting elements 38 with tapered cross-sectional size therebetween. In some embodiments, the sound conducting elements 38 are similar to the rectangular sound conducting conduit 18 in FIG. 10. In another embodiment, the array of sound conducting elements 38 in FIG. 15 could be formed by assembling a number of rectangular sound conducting conduit 18 in FIG. 10 side by side, for example using solder or adhesive.

The entire outer openings of the sound conducting elements 38 of the sound emission means 36 are appeared as a spherical profile or a curved profile. A loudspeaker is provided at the bottom (e.g., narrow end) of the enclosure 362 and is in sound communication with the sound source of the speaker body 12. The arrangement of the loudspeaker is similar to that of the loudspeaker 164, as shown in FIG. 2, except that the rectangular sound conducting elements 38 radially extend along substantial converged imaginary normal directions. Each sound conducting element 18 has an inner opening end and an exterior opening end opposite to the inner opening end. The inner opening end of the sound conducting element 18 is in sound communication with the loudspeaker.

The plurality of sound conducting elements 38 includes a group of front sound conducting conduits, a group of lateral sound conducting conduits, a group of upper sound conducting conduits, and a group of lower sound conducting conduits. Each of the four groups of sound conducting elements includes at least one rectangular sound conducting tube. In this way, the sound conducting elements 38 at both ends of the speaker body 12 form a left surround sound channel and a right sound channel relative to the listening location 19.

Figure 17:
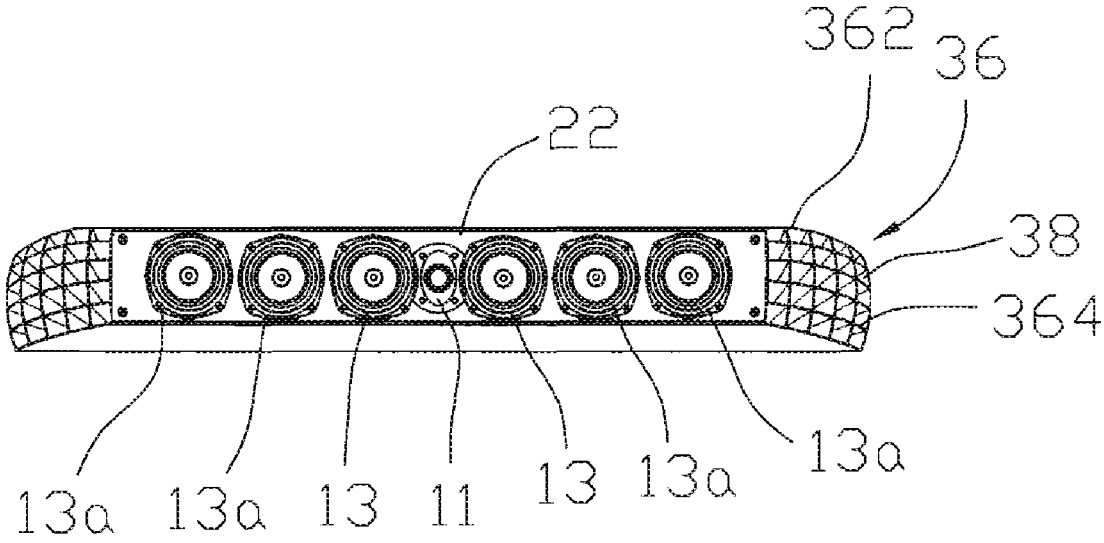
FIG. 17 is a schematic, isometric view of a multi-directional sound emission system according to a fourth embodiment of the present invention.

Referring to FIG. 17, a multi-directional sound emission system 40 is shown in accordance with a fourth embodiment of the present invention. The multi-directional sound emission system 40 is essentially similar to the above-described multi-directional sound emission system 30, except that the sound emission system 40 is a five-channel sound system. The reference numbers used in FIG. 17 are similar to those in FIGS. 15 and 16 and the parts designated by the same reference numbers to FIGS. 15 and 16 are similar to those parts described above.

The five-channel sound system of the sound emission system 40 has the same structure to the five-channel sound system of the sound emission system 20. The multi-directional sound emission system 40 includes the above speaker body 22 and the above two sound emission devices 14 coupled to both ends of the speaker body 22. The speaker body 22 is similar to the speaker body 22 in FIG. 12, e.g., including three pairs of center loudspeakers 13, 13*a*. The two sound emission devices 14 and the three pairs of center loudspeakers 13, 13*a* cooperatively constitute the five-channel sound system of the sound emission system 40.

Figure 18:
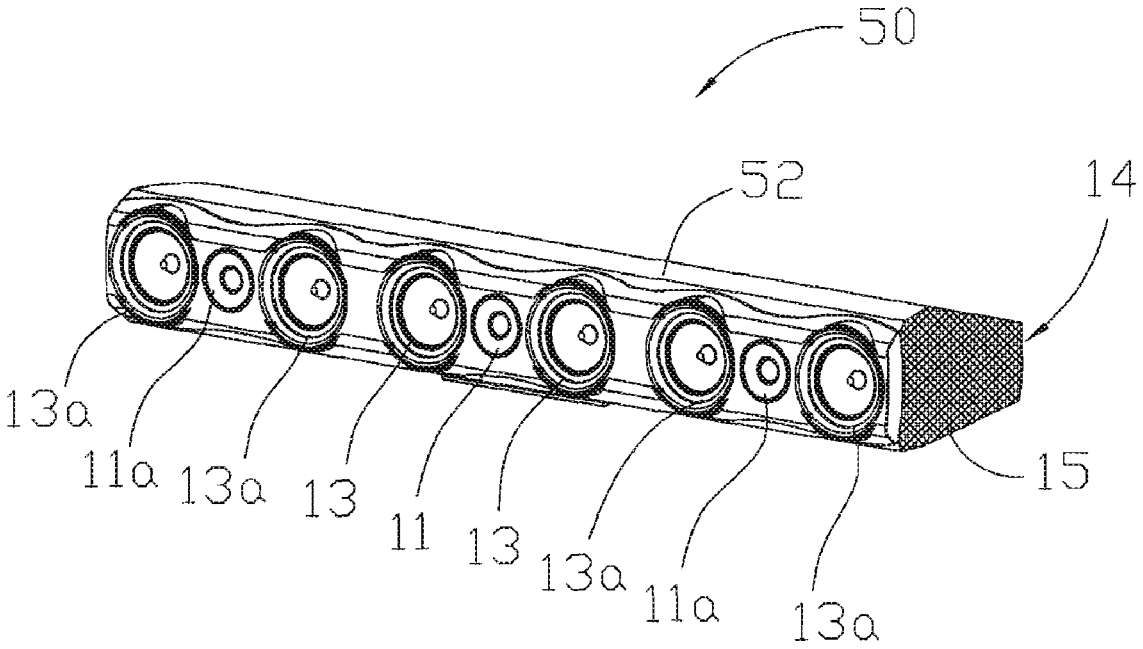
FIG. 18 is a schematic, isometric view of a multi-directional sound emission system according to a fifth embodiment of the present invention.

Referring to FIG. 18, a multi-directional sound emission system 50 is shown in accordance with a fifth embodiment of the present invention. The multi-directional sound emission system 50 is essentially similar to the above-described multi-directional sound emission system 20, except of the sound emission means 56. The reference numbers used in FIG. 18 are similar to those in FIG. 12 and the parts designated by the same reference numbers to FIG. 12 are similar to those parts described above.

The multi-directional sound emission system 50 includes a speaker body 52 and the above two sound emission devices 14 coupled to both ends of the speaker body 52. The speaker body 52 is similar to the speaker body 22 in FIG. 12, except that the outline of the speaker body 52 is streamlined. That is, a casing of the speaker body 52 is provided with streamlined edges, but not straight linear edges as illustrated in FIG. 12.

Figure 19:
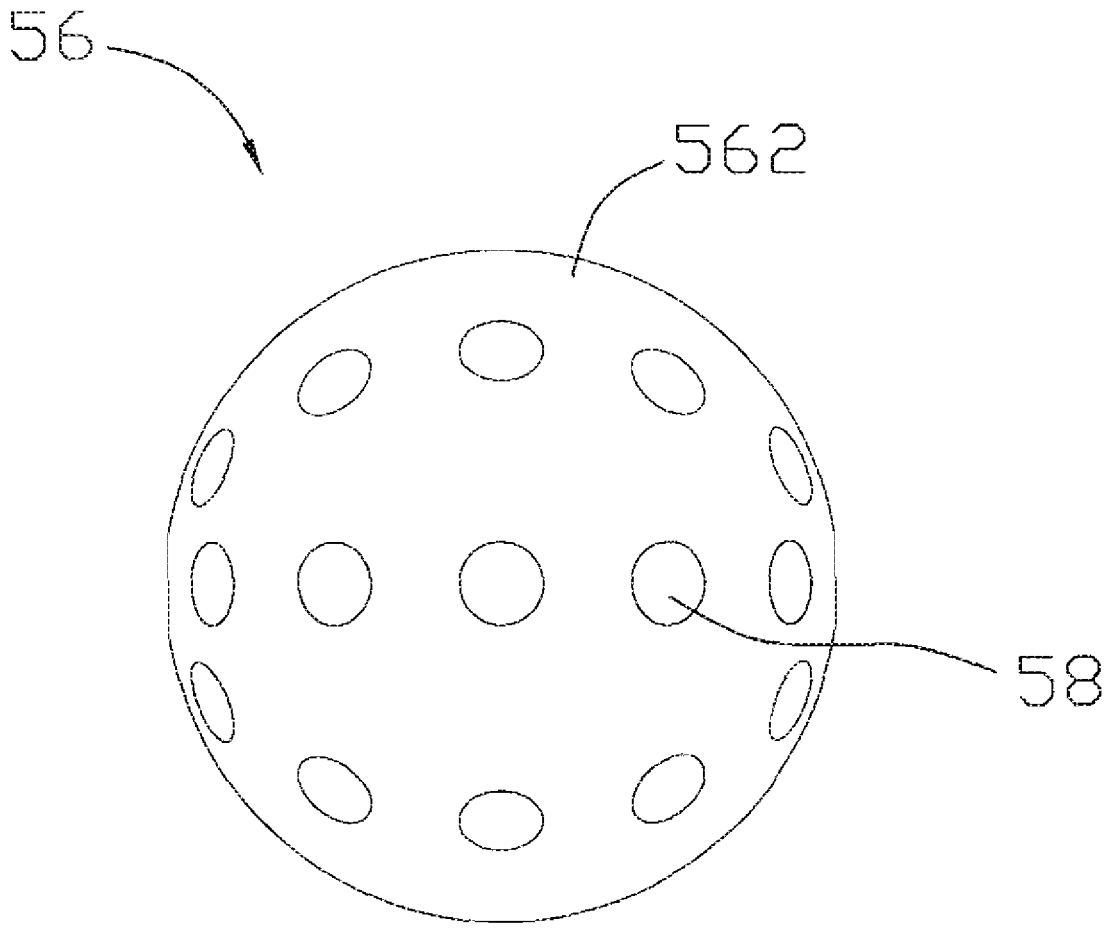
FIG. 19 is a schematic, isometric view of a mechanical sound conducting means of the multi-directional sound emission system of FIG. 18.

FIG. 19 illustrates the sound emission means 56 of the multi-directional sound emission system 50. The sound emission means 56 is in a sphere shape and includes a spherical base 562. In an alternative embodiment, the base 562 could be in a shape of hemisphere, frustum of sphere, and the likes. The spherical base 562 defines a plurality of sound conducting through-holes 58 as mechanical sound conducting elements. The plurality of sound conducting through-holes 58 could be defined in part (e.g., half or quarter) of the spherical base 562. The sound conducting through-holes 58 usefully extend along radial directions which are converged to a spherical center of the spherical base 562. It is to be understood that the arrangement of the sound conducting through-holes 58 defined in the spherical base 562 could be designed according to actual demands. A loudspeaker may be disposed inside the spherical base 562, for example at a center thereof, or be attached the spherical base 562. Each sound conducting through-hole 58 is in sound communication with sound exit (e.g., opening 166 if FIG. 2) of the loudspeaker. In case that the sound emission means 56 is in a hemisphere shape, the loudspeaker could be attached to a planar portion of the hemispherical sound emission means 56, similar to the arrangement of the loudspeaker 164 in FIG. 2. Each sound conducting through-hole 58 has an exterior opening end and an inner opening end opposite to the exterior opening end. The inner opening end of the sound conducting through-hole 58 is in sound communication with sound exit of the loudspeaker.

The sound conducting through-holes 58 are beneficially arranged in a uniform interval and have an identical or varying hole size. The sound conducting through-holes 58 include a group of front sound conducting through-holes, a group of lateral sound conducting through-holes, a group of upper sound conducting through-holes, and a group of lower sound conducting through-holes, thereby achieving a left surround sound channel and a right surround sound channel relative to the listening location. Each of the four groups of sound conducting through-holes includes at least one circular or rectangular through-hole. Accordingly, the sound conducting through-holes 58 and the three channels in the speaker body 52 cooperatively form a 5.1ch surround sound system.

The sound conducting conduits 18, the sound conducting conduits 38 and the sound conducting through-holes 58 described above could be replaced with one another but are not limited to be applied the above respective embodiments. The sound emission means could be designed to be a desired configuration for actual demands and be not limited to the above-mentioned structure.

In these multi-directional sound emission system described above, one sound emission system can achieve a multi-channel effect, for example, three-channel, five-channel, or more channels, by using the mechanical sound conducting means at both ends of the speaker body. The sound conducting means can allow the listener to receive sounds from a three-dimensional direction, for example, right front, lower front, both sides, top, backside of the listener, such that the listener feels that there are many imaginary loudspeakers around him/her and can enjoy a stereophonic effect with a plurality of channels. The multi-directional sound emission system achieves communication of sound by means of acoustic principle in physics and mechanical structure and is devoid of complex speaker devices, expensive digital process system, and complicated digital process circuit, which are required in traditional sound systems. Such a multi-directional sound emission system is compact in structure and is easy to assemble, thereby reducing cost in manufacture. Only one multi-directional sound emission system disposed to face towards the listener can achieve the stereophonic effect with a plurality of channels without any additional separate loudspeakers around the listener, thereby occupying small space in house and facilitating to carry away the sound emission system.

The present invention may be embodied in other forms without departing from the spirit or novel characteristics thereof. The embodiments disclosed in this application are to be considered in all respects as illustrative and not limitative. The scope of the invention is indicated by the appended claims rather than by the foregoing description; and all changes which come within the meaning and range of equivalency of the claims are intended to be embraced therein.

What is claimed is:

1. A multi-directional sound emission system, comprising:

a speaker body;

sound emission devices coupled to both ends of the speaker body, each sound emission device comprising a sound emission means configured for directionally emitting sound towards multiple directions, the sound emission means comprising a plurality of hollow mechanical sound conducting elements, each hollow mechanical sound conducting element having an inner opening end and an exterior opening end opposite to the inner opening end, the exterior opening ends of the sound conducting elements being directed towards desired multiple directions, respectively, the sound emission means being configured for receiving sound signals from the speaker body and emitting sound along the desired multiple directions through the sound conducting elements, wherein each sound conducting element protrudes from a surface of the sound emission devices.

2. The multi-directional sound emission system as claimed in claim 1, wherein a loudspeaker for receiving the sound signals from the speaker body is disposed at the sound emission means, the inner opening ends of the plurality of mechanical sound conducting elements being in sound communication with the loudspeaker.

3. The multi-directional sound emission system as claimed in claim 1, wherein the sound emission means further comprises a base, the plurality of mechanical sound conducting elements radially extending out of the base.

4. The multi-directional sound emission system as claimed in claim 3, wherein the plurality of mechanical sound conducting elements are radially distributed in a three-dimensional direction to emit sound along a plurality of directions in three-dimension.

5. The multi-directional sound emission system as claimed in claim 3, wherein the mechanical sound conducting elements are sound conducting conduits radially extending out of the base.

6. The multi-directional sound emission system as claimed in claim 5, wherein the sound conducting conduit is selected from the group consisting of: a straight tube, a curved tube, a tapered tube, a tube with a drum-shaped portion, and a tube with a rectangular opening.

7. The multi-directional sound emission system as claimed in claim 3, wherein the base is in a shape selected from the group consisting of: sphere, hemisphere, frustum of sphere, and enclosure.

8. The multi-directional sound emission system as claimed in claim 3, wherein the base is an enclosure, a plurality of separators being arranged in an array in the enclosure and being intersecting to each other to define the sound conducting elements there between.

9. The multi-directional sound emission system as claimed in claim 8, wherein the separators are fan-shaped panels and cooperatively form the sound conducting elements with tapered cross-sectional size.

10. The multi-directional sound emission system as claimed in claim 3, wherein the base is in a shape selected from the group consisting of: sphere, hemisphere, frustum of sphere, the base defining a plurality of sound conducting through-holes radially extending outwardly as the mechanical sound conducting elements.

11. The multi-directional sound emission system as claimed in claim 1, wherein the plurality of mechanical sound conducting elements comprises a group of front sound conducting elements, a group of lateral sound conducting elements, a group of upper sound conducting elements, and a group of lower sound conducting elements, the front sound conducting elements being directed to direct or biased front of the speaker body for propagating sound along a forward direction, the lateral sound conducting elements being directed to direct or biased lateral of the speaker body for propagating sound along a lateral direction, the upper sound conducting elements being directed to direct or biased above of the speaker body for propagating sound along an upward direction, the lower sound conducting elements being directed to direct or biased below of the speaker body for propagating sound along a downward direction.

12. The multi-directional sound emission system as claimed in claim 1, wherein the speaker body and the sound emission devices coupled to both ends thereof are integrated as a whole.

13. The multi-directional sound emission system as claimed in claim 1, wherein the speaker body comprises an audio middle frequency controller and two speakers coupled to both ends of the middle frequency controller to form a center channel.

14. The multi-directional sound emission system as claimed in claim 1, wherein the speaker body comprises three channels, each channel comprising an audio middle frequency controller and two speakers coupled to both ends of the middle frequency controller.

15. The multi-directional sound emission system as claimed in claim 1, wherein the mechanical sound conducting elements are configured for forming a left surround sound channel or a right surround sound channel.

16. The multi-directional sound emission system as claimed in claim 1, wherein each sound emission device further comprises a porous cover, the porous cover being configured for protecting the sound conducting elements therein and allowing sound to pass through.

17. The multi-directional sound emission system as claimed in claim 1, wherein the exterior opening ends of the sound conducting elements are appeared as a spherical profile or a curved profile.

18. The multi-directional sound emission system as claimed in claim 2, wherein the loudspeaker has an opening where the sound is emitted, the opening being in sound communication with the plurality of mechanical sound conducting elements, a mask being overlaid at the opening, the inner opening end of each sound conducting conduit being penetrated through the sphere mask to be in sound communication with the loudspeaker.

19. The multi-directional sound emission system as claimed in claim 1, wherein the sound emission means are configured for emitting sound along the desired multiple directions at the same time through the sound conducting elements.

* * * * *